United States Patent [19]

Saunders

[11] 4,040,357

[45] Aug. 9, 1977

[54] AIR TARGET FUZE

[75] Inventor: William K. Saunders, Bethesda, Md.

[73] Assignee: The United States of America as represented by the Secretary of the Army, Washington, D.C.

[21] Appl. No.: 797,310

[22] Filed: Mar. 4, 1959

[51] Int. Cl.[2] ..... F42C 13/04

[52] U.S. Cl. ..... 102/70.2 P; 343/14

[58] Field of Search ..... 102/70.2, 70.2 P; 314/14; 343/7, 14

[56] References Cited

U.S. PATENT DOCUMENTS

| | | | |
|---|---|---|---|
| 2,441,030 | 5/1948 | Page | 102/70.2 P |
| 2,570,295 | 10/1951 | Vantine | 102/70.2 P |
| 2,842,764 | 7/1958 | Harvey | 343/14 |
| 2,907,023 | 9/1959 | Skinner | 102/70.2 R |

*Primary Examiner*—Charles T. Jordan

*Attorney, Agent, or Firm*—Nathan Edelberg; Robert P. Gibson; Saul Elbaum

EXEMPLARY CLAIM

1. An improved air target fuze for use on a missile, said fuze comprising in combination: an oscillator, a modulator connected to frequency modulate said oscillator with a modulating waveform chosen so that the carrier frequency of said oscillator is changed from its initial value at approximately a $t^{2/3}$ rate, where $t$ represents time, until a predetermned frequency is reached, the wave then decreasing at a $-t^{2/3}$ rate until the carrier frequency returns to its initial value, the above cycle then repeating periodically, a sidewise looking transmitting antenna to which the frequency modulated output of said oscillator is fed, a sidewise looking receiving antenna for receiving a reflected wave from a target, a mixer to which the received wave and a portion of the transmitted wave are fed, a narrow band amplifier having a center frequency $f_o$ to which the output of said mixer is fed, said modulating waveform further being chosen so that at the fuze-to-target cut-off distance beyond which the fuze is not to respond the difference frequency between the transmitted and received waves when the transmitted wave has a frequency corresponding to said predetermined point is substantially equal to the center frequency $f_o$ of said amplifier, a detonator, and means connected to the output of said narrow band amplifier for functioning said detonator in response to the receipt of a signal from said amplifier.

3 Claims, 17 Drawing Figures

INVENTOR
WILLIAM K. SAUNDERS

BY S. J. Rotondi, A. J. Dupont, J. E. McGee & N. Cass

INVENTOR
WILLIAM K. SAUNDERS

BY S. J. Rotondi, A. T. Dupont,
T. E. McGee & N. Cass

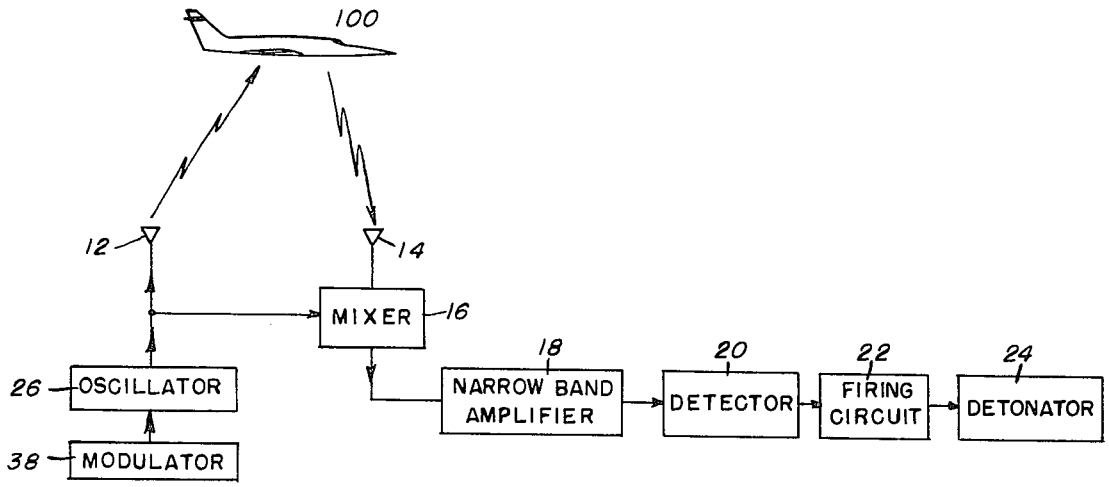
FIG. 15
FIG. 16
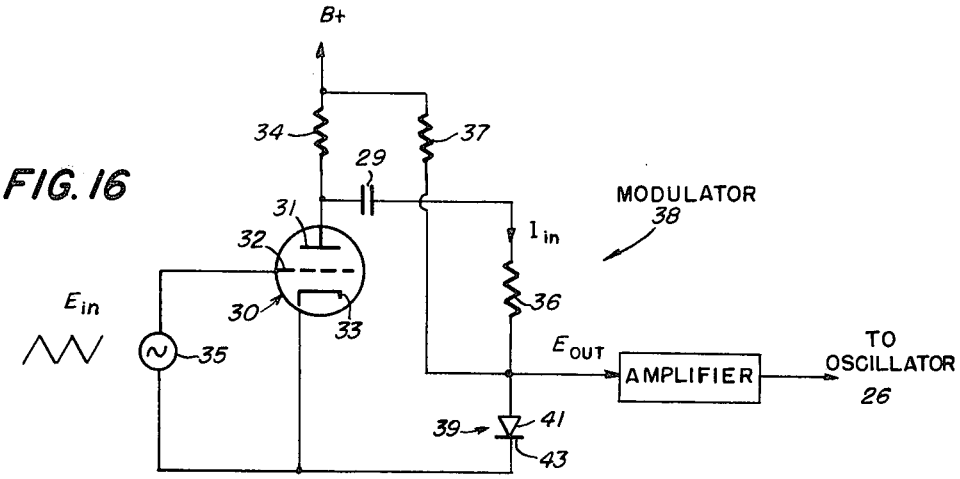
FIG. 17
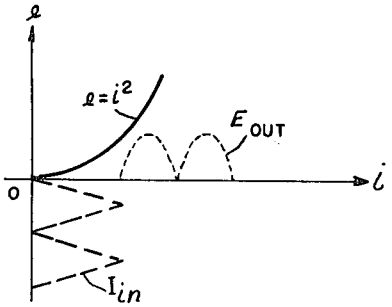
INVENTOR
WILLIAM K. SAUNDERS
BY S. J. Rotondi, A. T. Dupont, J. E. McGee & N. Cass

AIR TARGET FUZE

The invention described herein may be manufactured and used by or for the Government for governmental purposes without the payment to me of any royalty thereon.

This invention relates to fuzing systems in general, and more particularly to a fuze for use against air targets, such as an airplane or a guided missile.

A conventional air target fuze carries a sidewise looking antenna and the target passes suddenly through the antenna beam. It is important to realize that the target may intersect the antenna beam at any of a range of distances from the missile carrying the fuze. Thus, a first important characteristic of an air target fuze is that it be responsive to targets which intersect the beam from essentially zero distance from the target to the maximum distance at which the missile warhead could be effective in destroying the target. A second important requirement is that the air target fuze not be responsive to targets beyond the distance at which the missile warhead is effective. Otherwise, a passing object at some great distance away, or even the ground, would initiate warhead detonation and the missile would be destroyed before it could do any damage or reach its target. Thus, the fuze should be responsive to targets intercepting its beam out to the distance at which its warhead is effective, and beyond this distance should be entirely insensitive.

From the foregoing discussion, it can be seen that a mere altimeter system will not operate satisfactorily as an air target fuze. Some other techniques, therefore, must be resorted to in order to obtain the necessary fuze characteristics. Prior art designs for air target fuzes are deficient in the important respect that they do not provide what is known as a sharp cut-off; that is, a fuze characteristic in which the fuze is entirely insensitive to targets intercepting its antenna beam beyond the finite distance at which the missile warhead is effective. A second deficiency of prior art air target fuzes is that because they must be responsive to targets ranging from a distance very close to the missile to distances many hundreds of feet further out from the missile, it is necessary that the fuze receiver be capable of handling a very large range of signal amplitudes from the very small for distant targets to the very large for near targets. Patent application Ser. No. 460,789 filed Oct. b 6, 1954 for a "Low-Noise Fuze" by Henry P. Kalmus et al., is an example of an air target fuze system which exhibits these deficiencies.

The present invention provides an air target fuze which is very much closer to the ideal characteristics desired of an air target fuze than the above-mentioned fuzing system or any other prior art systems.

Accordingly, a broad object of this invention is to provide an improved air target fuze.

Another object is to provide an air target fuze having an improved cut-off characteristic.

A further object is to provide an air target fuze which, in addition to having a sharp cut-off, requires only a narrow band receiver with a relatively small dynamic range.

In the present invention, the above objects are accomplished by means of a frequency modulated electromagnetic transmitting and receiving system in which the waveform of the modulation signal applied to the transmitted wave is specially chosen to provide the desired air target fuze characteristics.

The specific nature of the invention, as well as other objects, uses and advantages thereof, will clearly appear from the following description and from the accompanying drawing, in which:

FIG. 15 is a block diagram of an embodiment of an air target fuze in accordance with the invention.

FIG. 16 is a schematic and block diagram of an electronic circuit for generating the desired modulating waveform.

FIG. 17 is a graph of the characteristics of the diode employed in the circuit of FIG. 16.

Before describing the improved air target fuze of the present invention and pointing out its advantages, some background material will first be presented.

Figure 1:
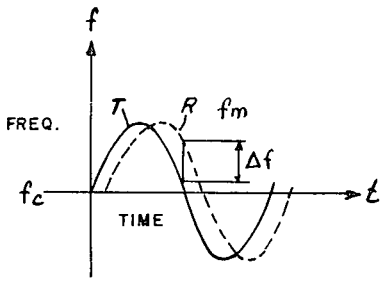
FIGS. 1–7 are graphs employed in presenting background information and showing characteristics of prior-art target fuzing systems.

Referring to FIG. 1, if a transmitter signal of frequency $f_c$ is frequency modulated by a sinusoidal signal at a modulation frequency $f_m$, the relationship between the frequencies of the transmitted and received waves will be as shown by the solid and dashed lines T and R, respectively, in FIG. 1. If the modulation is triangular, rather than sinusoidal, the relationship between the frequencies of the transmitted and received waves will be as shown by the solid and dashed lines T and R in FIG. 2. At any given time $t$, the difference frequency $\Delta f$ between the transmitted and received waves is the vertical distance between the curves representing the transmitted and received waves T and R.

It is well known in the art that after mixing the transmitted and received signals T and R, a difference-frequency spectrum is obtained from the output of the mixer consisting of the fundamental modulating frequency $f_m$ and harmonics thereof with an amplitude A vs. frequency $f$ distribution which is dependent upon the shape of the modulating wave $f_m$, the average frequency of the distribution being proportional to the distance between the fuze and the target regardless of the shape of the distribution.

Figure 3:
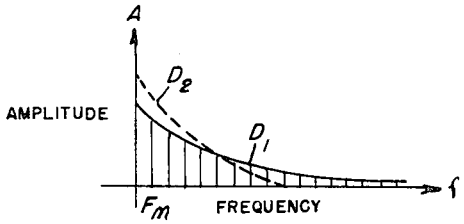

FIG. 3 shows the amplitude A vs. frequency $f$ distribution obtained for the sinusoidal modulation of FIG. 1 after mixing the waves T and R. The vertical lines represent the amplitudes of the signals of frequency $f_m$ and harmonics thereof. A solid line is drawn through the peaks of these signals forming an envelope. Hereafter, the envelope alone will be used to represent the amplitude A vs. frequency $f$ distribution without showing the individual modulation frequency components. The solid line $D_1$ in FIG. 3 represents the distribution envelope obtained for a first distance between fuze and target, while the dashed line $D_2$ represents the distribution envelope obtained for a shorter distance between fuze and target. It is well known that for any shape distribution, the average frequency of the distribution moves towards zero frequency as the distance between the fuze and target decreases.

Figure 2:
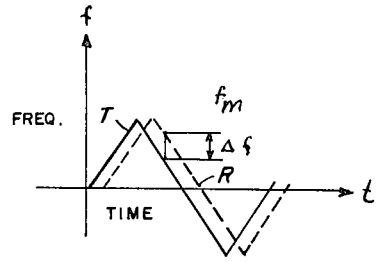
Figure 4:
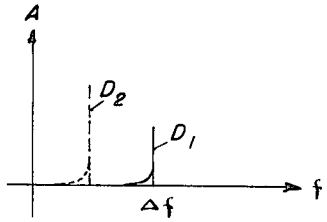

FIG. 4 shows the distribution obtained for the triangular modulation of FIG. 2 after mixing the signals T and R. The solid line $D_1$ represents the distribution envelope obtained for a first distance between fuze and target while the dashed line $D_2$ represents the distribution envelope for a shorter distance between the fuze and target. Because the difference frequency $\Delta f$ at a given distance is substantially constant when triangular modulation is employed as can be seen from FIG. 2, the distribution will be rather sharply shaped so that it is peaked at about the average frequency $\overline{\Delta f}$.

FIGS. 1–4 thus illustrate how the shape of the modulating wave has a considerable effect on the shape of the resulting amplitude A vs. frequency $f$ distribution after mixing. It is to be noted, however, that for all distributions the average difference frequency $\overline{\Delta f}$ of the distribution will be proportional to the fuze-to-target distance and will approach zero frequency as the distance gets smaller.

For an air target fuze, therefore, the amplitude A vs. frequency $f$ distribution may be used to provide information as to the relation between the fuze and the target. One way of employing this distribution is to measure the average frequency $\overline{\Delta f}$ by some well known means, such as frequency counter circuits, to obtain a measure of fuze-to-target distance. If the average frequency $\overline{\Delta i}$ f corresponding to the distance is below the value at which the missile warhead would be effective, means could then be employed to detonate the missile warhead. There are two difficulties with this type of air target fuze. First, since the air target fuze must respond over a wide range of distances, the fuze receiver must necessarily be responsive to a wide range of frequencies, so that a receiver having a very large bandwidth is required. Secondly, the receiver must respond to a very large range of signal amplitudes because of the wide range of distances at which the fuze must respond. This type of system, therefore, has had little use for air target fuzes.

Another way of employing the amplitude A vs. frequency $f$ distribution is to pick out one of the individual frequencies, such as the modulation frequency $f_m$, or perhaps some harmonic of the modulation frequency $nf_m$, and use the variation in the amplitude of this individual frequency with distance to indicate if the target is within the distance at which it is desired to detonate the warhead. This is the method employed by the previously-mentioned patent application of Henry P. Kalmus et al. and has the advantage of permitting a narrow band fuze receiver to be used. The chief deficiencies in this system however, as previously stated, are that the system does not provide a sharp cut-off and requires a fuze receiver capable of handling a very considerable range of signal amplitudes.

Figure 5:
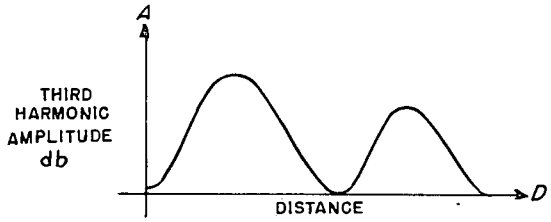

FIG. 5 shows the variation of the amplitude A (in db) of the third harmonic of the fundamental modulating frequency $f_m$ vs. fuze-to-target distance in a system such as described in the abovementioned patent application. The third harmonic frequency is ordinarily employed in this type of air target fuzing system for the reason that it is usually out of the microphonic range and does not give too bad a range cut-off characteristic. It can be seen from FIG. 5, however, that the range cut-off characteristic is far from sharp and thus makes it difficult to control the cut-off distance with any degree of accuracy. It is to be understood that the third harmonic modulation frequency amplitude vs distance characteristic shown in FIG. 5 takes into account only the variation caused by changes in the amplitude vs. frequency distribution. The variation caused by attenuation of the signal as a result of the transmitted signal having to travel a greater round trip distance before being received is shown in FIG. 6.

Figure 6:
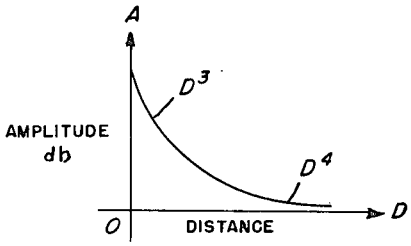
Figure 7:
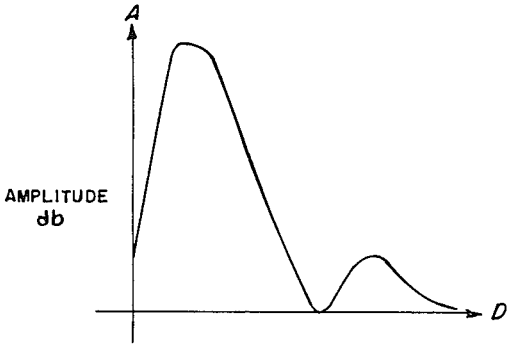

FIG. 6 shows the amplitude A (in db) which is received at the fuze for various fuze-to-target distances without taking into account any variation due to amplitude vs. frequency distribution changes. Initially the return signal amplitude decreases at 1/D 3 rate for near targets and at a 1/D 4 rate for targets sufficiently far away so that the target is fully illiminated by the fuze antenna. Combining the received signal vs. distance characteristic shown in FIG. 6 (caused by signal attenuation with distance) with the third harmonic modulation frequency amplitude vs. distance characteristic shown in FIG. 5 (caused by amplitude vs. frequency distribution changes with distance), the resultant third harmonic signal received at the fuze due to both effects will appear somewhat as shown in FIG. 7. It is obvious from FIG. 7 that not only is the cut-off far from sharp but also, the fuze receiver must be capable of handling a very cnsiderable range of signal amplitudes.

Figure 8:
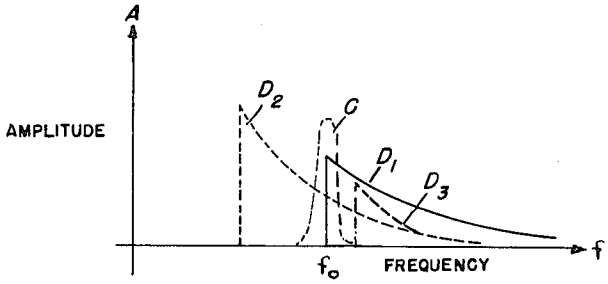
FIGS. 8–10 are graphs illustrating the characteristics of an ideal air target fuze.
Figure 9:
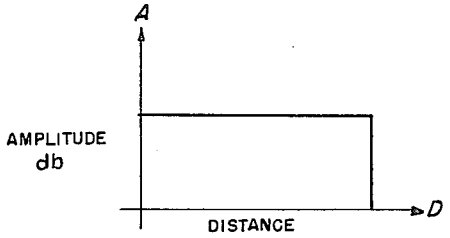

In accordance with the present invention, it has been discovered that an air target fuze having greatly improved characteristics can be achieved by providing a modulation signal having a specially shaped waveform. To approach the problem of determining what shape modulation waveform is most desirable, the amplitude A vs. frequency $f$ distribution which would give the best characteristics must first be determined. After careful analysis it was discovered that the distribution which could be expected to give the best fuze characteristics was that having the shape shown by the solid and dashed envelopes $D_1$, $D_2$ and $D_3$ in FIG. 8. The distribution is shaped such that its amplitude decreases at a rate substantially in accordance with the decrease of a received signal at the fuze due to distance attenuation as shown in FIG. 6. That is, the amplitude of the distribution envelope first decreases at a rate of $1/f$ 3 and then $1/f$ 4. For this shape distribution the fuze receiver should have a narrow bandwidth in the vicinity of $f_o$ as shown by the dotted curve C in FIG. 8. At the maximum distance at which it is desired that the fuze respond, the distribution should be located as shown by $D_1$ with the minimum frequency of the distribution substantially at $f_o$. For a greater distance than the distance represented by the solid envelope $D_1$, therefore, it can be seen that no signal having a frequency within the narrow bandwidth of the receiver will be received, since the distribution will move to the right as indicated by the dashed envelope $D_3$ in FIG. 8. At smaller fuze-to-target distances, it can be seen that the amplitude of the frequency components within the narrow pass band of the receiver will decrease at substantially the same rate as the signal received by the fuze increases, due to the decrease in fuze-to-target distance. The resultant amplitude vs. distance characteristic of the fuze for the signal frequencies within the narrow bandwidth of the receiver will thus be the ideal air target fuze characteristic shown in FIG. 9. For this ideal characteristic, signals received by the fuze within the bandwith of the receiver will have a constant amplitude until the distance at which the missile warhead is no longer effective, and beyond this predetermined distance no signal frequencies capable of passing the receiver will be received.

In effect, therefore, the amplitude vs. frequency distribution is first chosen to have a minimum frequency substantially equal to the center frequency $f_o$ of the narrow band fuze receiver at the maximum distance the fuze is to respond, so that at greater distances the distribution will have no frequencies within the receiver bandwidth. Secondly, the amplitude vs. frequency distribution is chosen so that for the narrow band of frequencies to which the fuze receiver responds, the variation in the amplitude of these frequency components received by the fuze due to distance will be substantially cancelled out by the variation in these frequency components caused by changes in the amplitude vs. frequency distribution with distance.

Figure 10:
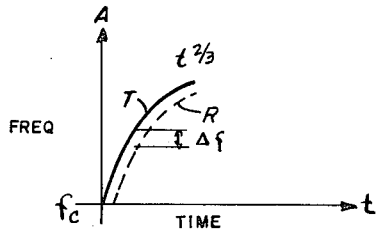

To discover the shape of the amplitude A vs. frequency $f$ distribution which is most desirable is just the first step, since the problem still arises as to what shape of modulating waveform will give the desired distribution arrived at above. Mathematical calculations show that a modulating waveform which increases at a rate of $t^{2/3}$, producing the relationship between the transmitted and received waves T and R as shown in FIG. 10, would provide the desired distribution shown in FIG. 8 after the transmitted and received waves are mixed. However, since it is necessary to provide a modulating waveform which is periodic and thus will have to turn around, a practical modulating waveform must necessarily be only an approximation of the desired relationship shown in FIG. 10.

Figure 11:
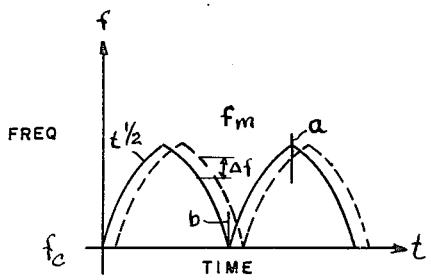
FIGS. 11–14 are graphs illustrating the characteristics of an embodiment of an air target fuze in accordance with the invention.

A periodic modulating waveform shape which has been found successful in an embodiment of an air target fuze in accordance with the invention is shown in FIG. 11. Although it is most desirable that the wave rise at a $t^{2/3}$ rate and such a rate could be generated if desired, a $t^{1/2}$ rate has been chosen as a sufficient approximation for a practical embodiment because it is much easier to generate. It is to be understood, however, that other waveform approximations may be chosen within the scope of the invention. The present approximation is chosen principally because it is relatively easy to generate with simple circuitry. The amplitude A vs. frequency $f$ distribution obtained for the modulating waveform of FIG. 11 after mixing is shown by the envelope $D_{max}$ in FIG. 12 for the case of maximum fuze-to-target distance at which it is desired that the fuze be sensitive. It can be seen that the shape of the distribution is not perfect in that it has a relatively small amount of energy at frequencies below the desired minimum frequency, and instead of trailing off gradually, abruptly stops at some maximum frequency. It has been found that the difference frequency $\Delta f$ at the point a in FIG. 11 for a given fuze-to-target distance substantially corresponds to the desired minimum frequency at which the peak amplitude of the envelope is obtained, while the difference frequency $\Delta f$ at the point $b$ has been found to correspond to the maximum frequency of the distribution.

Figure 12:
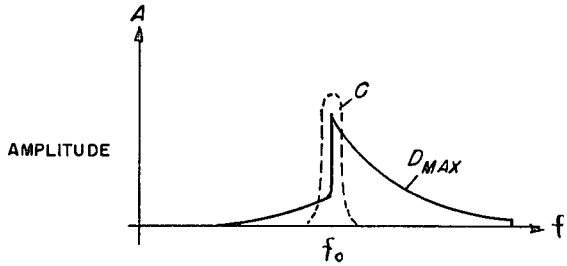
Figure 13:
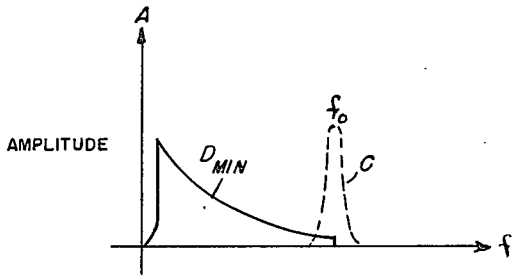

Thus, the waveform shown in FIG. 11 is chosen so that at the maximum distance at which it is desired that the fuze be sensitive, the difference frequency at point $a$ will be equal to the frequency $f_o$ of the fuze receiver whose response is shown by the dotted line C in FIG. 12. Since the distribution envelope moves toward zero frequency as distance decreases, a point will be reached where the maximum difference frequency $\Delta f$ produced by the waveform of FIG. 11 at $b$ will be the receiver frequency $f_o$, as shown by the envelope $D_{min}$ in FIG. 13. Ideally, this is the minimum distance at which a fuze having the modulating waveform of FIG. 11 should be sensitive. However, as long as this distance is relatively close to the fuze, say about ten feet, it has been found that multiple reflections from the target and the effects of the reduced lobes of the antenna pattern are still able to produce a signal at these small distances which will operate the fuze to detonate the missile warhead.

Figure 14:
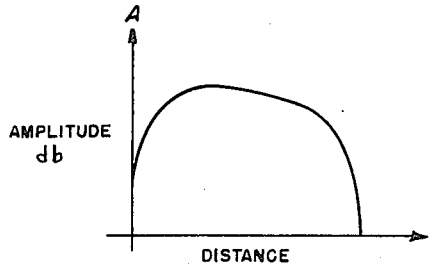

In a typical embodiment of the invention employing the modulating waveform of FIG. 11, the resultant amplitude vs. distance characteristic for the signal frequencies received at the fuze within the bandwidth of the receiver is as shown in FIG. 14. It can be seen that because the waveform of FIG. 11 is only an approximation of the ideal modulating waveform of FIG. 10, the characteristic of FIG. 14 only approximates the ideal air target characteristic of FIG. 9. However, in comparison with the curve of FIG. 7 for the prior art fuzing system described in the previously-mentioned patent application of Kalmus et al., the characteristic shown in FIG. 14 achieves a very great improvement in the sharpness of cut-off, and also in the range of signal amplitudes which the fuze receiver must be capable of handling.

FIG. 15 shows a block diagram of a typical embodiment of an air target fuzing system in accordance with the invention. A modulator 38, which produces the waveform shown in FIG. 11, frequency modulates an oscillator 26, the resultant modulated wave being radiated from the antenna 12 to a target 100. The antenna 12 is adapted to have a sidewise looking radiation pattern, as is conventionally provided in air target fuzes. Those skilled in the art will readily be able to provide an antenna having the necessary radiation pattern.

A sidewise looking receiving antenna 14 receives from the target a reflected signal 100 that is mixed in a mixer 16 with a portion of the transmitted signal. The receiving antenna 14, like the transmitting antenna 12, is of conventional design. The output of the mixer 16 has an amplitude A vs. frequency $f$ distribution having the shape shown in FIGS. 12 and 13, the location of the envelope depending upon the fuze-to-target distance. The output from the mixer 16 is fed to a narrow band amplifier 18 having a center frequency $f_o$. Since the amplifier 18 need not be capable of handling a large range of signal amplitudes, its circuitry may be relatively simple. In accordance with the previous discussion it will be understood that the amplifier 18 will produce a pulse of energy at its output having a frequency of substantially $f_o$ as the target traverses the fuze antenna beam only if the fuze-to-target distance is less than the predetermined cut-off distance. The output of the narrow band amplifier 18 may then be fed to a detector 20 which may be tuned to $f_o$ where it is shaped to a pulse which will trigger the firing circuit 22, igniting the detonator 24 and thereby causing detonation of the missile warhead (not shown). The narrow band amplifier 18, the detector 20, the firing circuit 22 and the detonator 24 may all be of well known design.

FIG. 16 illustrates one type of modulator 38 which may be used to generate the modulating waveform shown in FIG. 11. A saw-tooth generator 35 generating a wave $E_{in}$ feeds its signal to the grid 32 of a vacumm tube 30 having its cathode 33 grounded and its plate 31 connected to a d-c voltage source through a resistor 34. One end of a resistor 36 is connected to the plate 31 through a coupling capacitor 29 and the other end of the resistor 36 is connected to the cathode 33 through a germanium diode 39 having its cathode 43 connected to the tube cathode 33 and its plate 41 connected to the other side of the resistor 36. The resistor 36 is chosen much larger than the forward resistance of the diode 39 so that the current $I_{in}$ flowing through the diode 39 is directly proportional to the voltage on the plate 31. A resistor 37 connected between B+ and the plate 41 provides a d-c current bias for the diode 41. The resistors 34, 36 and 37 are chosen so that the current $I_{in}$ through the diode 39 varies from zero to some maximum value, as shown by the dashed triangular waveform $I_{in}$ in FIG. 17. FIG. 17 shows the e vs. i characteristics of the germanium diode 39 which, for most germanium diodes, is of the form $e = i^2$. The voltage $E_{out}$ at the plate 41 of the diode 39 will thus be as indicated by the dashed waveform $E_{out}$ in FIG. 17, which is the desired modulating waveform shown in FIG. 11. Before being applied to the oscillator 26 for frequency modulation thereof, the waveform $E_{out}$ may first be amplified by an amplifier 40.

In accordance with the previous discussion in connection with FIG. 11, the frequency deviation of the carrier of frequency $f_c$ is chosen so that the difference frequency at point *a* in FIG. 11 for the predetermined distance at which cut-off is desired is substantially equal to the center frequency $f_o$ of the narrow band amplifier 18. Also, the modulating frequency $f_m$ of the waveform of FIG. 11 is chosen to permit a sufficient number of cycles to be observed by the fuze receiver for the fastest target expected to pass through the fuze antenna beam. As previously pointed out, the distance for which the maximum frequency of the amplitude vs. frequency distribution is at the frequency $f_o$ (see FIG. 13) is theoretically the minimum distance at which the fuze will be responsive. However, as explained above, the presence of multiple reflections and the effect of the reduced lobes of the antenna pattern have been found to enable operation of the air target fuze down to zero fuze-to-target distance. Also, the slight spread of the narrow band amplifier shown by the dotted curve C in FIGS. 12 and 13 additionally helps to overcome this close distance problem.

An air target fuze responsive to targets up to 600 feet has been designed in accordance with the present invention having a modulating frequency $f_m$ of about 25 kilocycles with a wave shape generated by the circuit of FIG. 16. The center frequency $f_o$ of the narrow band amplifier 18 was chosen as 1 megacycle with a bandwidth of 100 kilocycles. The resultant amplitude vs. distance characteristic obtained is quite similar to that shown by FIG. 14.

It will be apparent that the embodiments shown are only exemplary and that various modifications can be made in construction and arrangement within the scope of the invention as defined in the appended claims.

It is to be understood that although the invention has been illustrated as embodied in an air target fuze, the invention is also applicable to any use where characteristics similar to those required in an air target fuze are desired. For example, the invention could be applied for use as an airplane anti-collision radar to warn of the presence of an object within a predetermined distance from the airplane.

We claim as our invention:

1. An improved air target fuze for use on a missile, said fuze comprising in combination: an oscillator, a modulator connected to frequency modulate said oscillator with a modulating waveform chosen so that the carrier frequency of said oscillator is changed from its initial value at approximately a $t^{2/3}$ rate, where $t$ represents time, until a predetermined frequency is reached, the wave then decreasing at a $-t^{2/3}$ rate until the carrier frequency returns to its initial value, the above cycle the repeating periodically, a sidewise looking transmitting antenna to which the frequency modulated output of said oscillator is fed, a sidewise looking receiving antenna for receiving a reflected wave from a target, a mixer to which the received wave and a portion of the transmitted wave are fed, a narrow band amplifier having a center frequency $f_o$ to which the output of said mixer is fed, said modulating waveform further being chosen so that at the fuze-to-target cut-off distance beyond which the fuze is not to respond the difference frequency between the transmitted and received waves when the transmitted wave has a frequency corresponding to said predetermined point is substantially equal to the center frequency $f_o$ of said amplifier, a detonator, and means connected to the output of said narrow band amplifier for functioning said detonator in response to the receipt of a signal from said amplifier.

2. In the design of a radiant energy sending and receiving condition responsive system which is adapted to be responsive to an object within a predetermined range of distances from said system, the method of making said system have a sharp cutoff beyond said predetermined range and require only a narrow band receiver with a relatively small dynamic range, comprising the steps of: providing a received energy waveform having a minimum frequency equal to the center frequency of said narrow band receiver at the maximum distance at which said system is to respond by controlling the amplitude versus frequency distribution of the received energy, and causing the variation in the amplitude of the received energy due to distance for the narrow band of frequencies to which said receiver responds to cancel out the variation in the frequency components within said narrow band of frequencies caused by changes in the amplitude versus frequency distriution due to distance by controlling the waveform of the transmitted energy.

3. A condition responsive system including: radiant energy transmitting means, narrow band receiving means, means for controlling the amplitude versus frequency distribution of the received energy to have a minimum frequency at the center frequency of said narrow band receiver for the maximum response distance of said system, means for cancelling the variation in amplitude of the received energy due to distance by the variation with distance of the frequency components within the band of said receiving means, said last named means comprising means for controlling the waveform of the transmitted energy.

* * * * *